US005107773A

United States Patent [19]

Daley et al.

[11] Patent Number: 5,107,773

[45] Date of Patent: Apr. 28, 1992

[54] RAILWAY TRUCKS

[75] Inventors: Richard A. Daley; Henry Martin; Wolfgang G. Reimann, all of Hamilton, Canada

[73] Assignee: Dofasco Inc., Canada

[21] Appl. No.: 588,899

[22] Filed: Sep. 27, 1990

[51] Int. Cl.[5] ..... B61F 5/02; B61F 5/30

[52] U.S. Cl. ..... 105/185; 105/199.2; 105/218.1; 105/224.1

[58] Field of Search ..... 105/185, 190.1, 199.1, 105/199.2, 200, 207, 224.1, 218.1, 168

[56] References Cited

U.S. PATENT DOCUMENTS

| | | | |
|---|---|---|---|
| 3,628,465 | 12/1971 | Dobson et al. | 105/185 X |
| 4,185,854 | 1/1980 | Brando | 105/182.1 X |
| 4,295,428 | 10/1981 | Dickhart, III et al. | 105/168 |
| 4,648,326 | 3/1987 | Jackson | 105/199.1 X |

FOREIGN PATENT DOCUMENTS

| | | | |
|---|---|---|---|
| 3026528 | 2/1982 | Fed. Rep. of Germany | 105/224.1 |

*Primary Examiner*—Robert J. Oberleitner
*Assistant Examiner*—Kevin D. Rutherford
*Attorney, Agent, or Firm*—Rogers & Scott

[57] ABSTRACT

A railway truck has a unitary cast steel frame with a primary wheel-set-to-frame suspension formed by chevron shaped metal/elastomeric pads between the journals and the frame pedestals, a secondary frame-to-bolster suspension formed by rectangular elastomeric pads in rectangular configuration, and a tertiary suspension between the bolster and the car. The primary suspension units are mounted by L-shaped members permitting ready vertical adjustment. An anti-roll torsion bar is provided between the bolster and the car body despite the limited available space by disposing it inside the bolster. Closer clearances are possible between the truck components by providing a cam and cam follower between the car body and the truck frame, in this embodiment between the bolster and the truck frame, that limits the possible lateral displacement of the car body as the steering angle of the car body on the truck frame increases.

13 Claims, 4 Drawing Sheets

RAILWAY TRUCKS

FIELD OF THE INVENTION

The invention is concerned with improvements in or relating to railway trucks, and especially to the suspension systems which are employed in such trucks, for the support of the wheel and axle combinations on which the vehicle runs, and for the support of a car body on a longitudinally spaced pair of such trucks.

REVIEW OF THE PRIOR ART

The design and manufacture of railway trucks is now a mature art with numerous prior proposals intended to produce the best possible ride of the vehicle consistent with the required economy of manufacture and operation. In the case of passenger rail vehicles there is a specially onerous requirement for an adequately comfortable ride, despite the wide range of loadings presented respectively by a relatively empty and completely full vehicle, and the generally low quality of the road beds on which in practice such vehicles must run, together with the usual requirement from the operators to reduce wheel and rail wear and truck maintenance in order to reduce running costs.

DEFINITION OF THE INVENTION

It is therefore the principal object of the invention to provide a new railway truck having a suspension system able to provide the required "passenger quality" ride together with a robust, low maintenance and economic construction.

In accordance with the present invention there is provided a railway truck comprising:

a truck frame having two parallel side frame members connected by a transversely extending transom and supporting two longitudinaly spaced wheel and axle sets on which the truck runs;

primary suspension means mounting the wheel and axle sets on the frame;

a hollow bolster extending transversely centrally of the frame;

secondary suspension means mounting the bolster on the frame for pivoting and lateral movement with respect thereto;

tertiary suspension means mounted on the bolster for attachment to the underside of the car body to mount the car body thereon for vertical movements; and a torsion bar extending transversely through the interior of the hollow bolster and mounted for free rotation therein, the two ends of the torsion bar extending from the respective ends of the bolster for connection to the car body, whereby vertical movement of the car body is unopposed because of rotation of the torsion bar, and roll movement of the car body on the bolster is opposed by torsion of the torsion bar.

Also in accordance with the invention there is provided a railway truck comprising:

a truck frame having two parallel side frame members connected by a transversely extending transom and supporting two longitudinaly spaced wheel and axle sets on which the truck runs;

primary suspension means mounting the wheel and axle sets on the frame;

a bolster extending transversely centrally of the frame;

secondary suspension means mounting the bolster on the frame;

tertiary suspension means mounted on the bolster for attachment to the underside of the car body to mount the car body thereon; and cam means having respective co-operating portions operative upon rotation of the car body relative to the truck frame from a straight-ahead steering attitude to reduce the permitted lateral movement of the car body on the truck frame.

Further in accordance with the invention there is provided a railway truck comprising:

an integral truck frame having two transversely spaced parallel side frame members providing respective pairs of pedestal portions with each pair of pedestal portions supporting a respective pair of bearing journals in which is mounted a respective axle and wheel set on which the truck runs;

each pedestal having on respective parallel legs thereof two longitudinally spaced parallel opposed journal support surfaces against which a respective journal assembly can move vertically to adjust the height of the respective journal in the frame;

each journal assembly comprising two L-shaped intermediate members each having a vertical body part which is interposed between its journal and a respective leg of its pedestal and provides a vertical bearing surface butting and movable vertically against the respective vertical pedestal leg journal support surface; and each L-shaped intermediate member having a horizontal body part which is engaged with a corresponding lower horizontal surface of its pedestal leg to determine the vertical height of the journal, so that the height is adjustable by the interposition of thickness shims between the L-shaped member horizontal body part and the pedestal leg horizontal surface.

DESCRIPTION OF THE DRAWINGS

Particular preferred embodiments of the invention will now be described, by way of example, with reference to the accompanying diagrammatic drawings, wherein.

DESCRIPTION OF THE PREFERRED EMBODIMENTS

Figure 1:
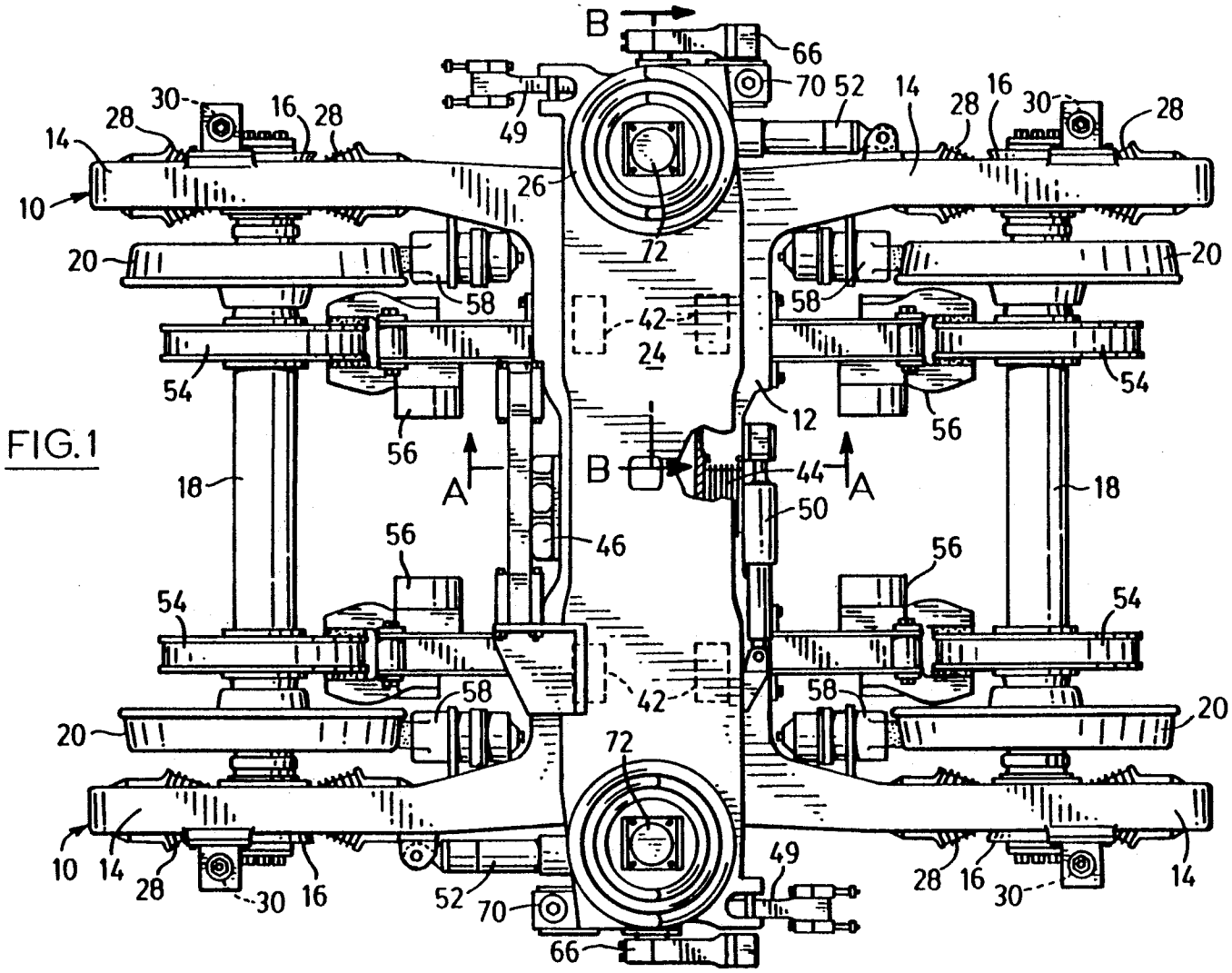
FIG. 1 is a plan view of a passenger railway truck employing the invention, parts thereof being shown broken away as necessary for clarity of illustration.

The particular railway truck illustrated is of unitary cast steel construction comprising two spaced parallel side frames 10 the opposite central portions of which are deeply depressed to accommodate the bolster and the tertiary suspension by which a car body is mounted thereon, so that they are disposed as low as possible and thereby reduce the overall height of the truck. The side frames are connected by two integral longitudinally closely spaced transoms 12 and provide four integral corner pedestals 14, each of which receives and mounts a respective wheel bearing block or journal 16 in a respective journal assembly. The two bearing blocks at adjacent ends support a respective axle and wheel combination comprising an axle 18 and wheels 20 on which the truck runs. The car body 22 is illustrated in the various figures by broken line outlines and is supported on the truck via a transverse bolster 24 carried on the truck by a pivoting secondary spring suspension described below, the bolster in turn carrying tertiary spring suspension members 26 on which the car body is mounted and which will be described below.

Figure 2:
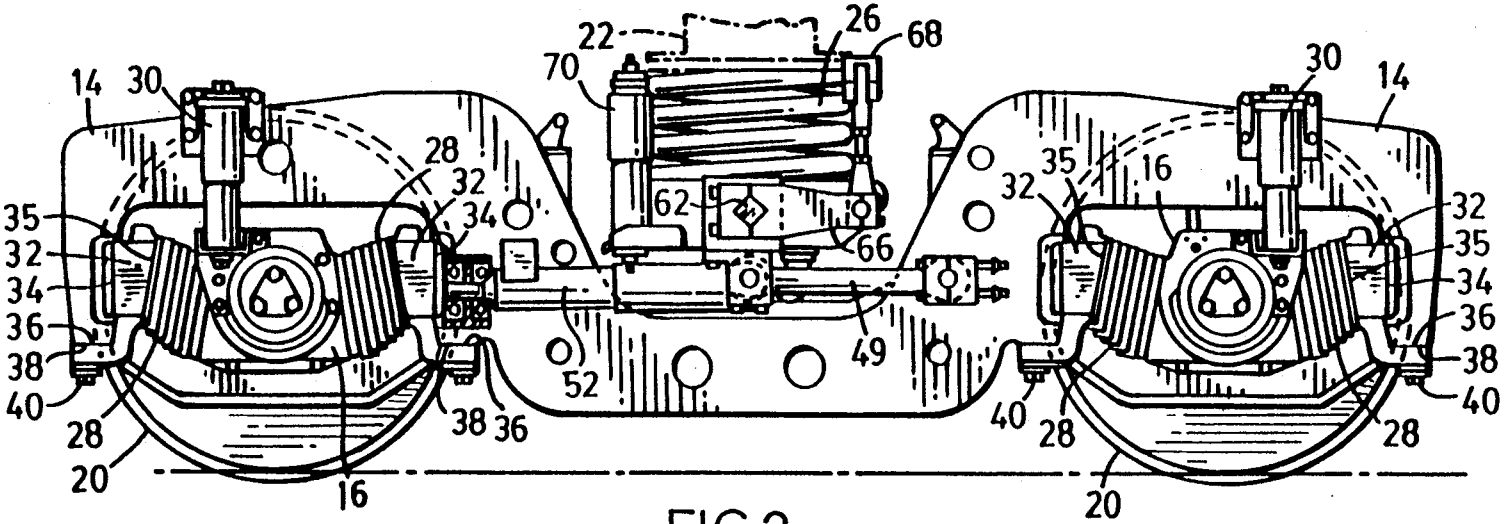
FIG. 2 is a side elevation of the truck of FIG. 1.

Referring now particularly to FIG. 2, the primary suspension between each journal 16 and its pedestal 14 comprises for each journal assembly two opposed elastomeric suspension members 28 of known chevron shape, each consisting of a plurality of elastomeric pieces sandwiched between thin metal plates, the pieces and plates being of chevron shape in plan with the concave sides of the chevrons facing one another. In other embodiments the chevrons can be reversed in their orientation. The two suspension members 28 supporting each journal 16 have their longitudinal compression axes decline (i.e. sloped downwardly) toward each other so that upward movement of the journal produces compression of the elastomeric portions, increasing the vertical constraint that they provide and centering the vertical travel. Damping of the vertical motion is provided by a damper 30 connected between the journal and the pedestal Such primary spring suspension units can be made to provide adequate flexibility vertically, longitudinally and transversely to give good control of axleset motions to minimize hunting (yaw) oscillations, so as to provide the required "passenger comfortable" ride over a wide range of loadings, while permitting the wheels to accommodate to the normal variations in track profile encountered in operation without applying unacceptable loads on the rails, and without requiring the coupling of the two journals at each side by an equalizer beam.

Each suspension member 28 is mounted on its respective leg of its pedestal by an L-shaped intermediate mounting member 32, the larger and longer vertical body portion of which has a bearing surface comprising a vertical smoothly machined face 34 that butts against, and can move vertically against, a corresponding parallel vertical journal support surface comprising a smoothly machined face of the pedestal leg. The vertical body portion is tapered to be wedge-shape in side elevation, narrowing downwards in a vertical longitudinal plane, providing a surface 35 with the required chevron shape and inclination to receive the butting end of the respective chevron shape suspension member 28. The shorter horizontal portion of each intermediate member has a smooth horizontal upper face 36 that butts against a corresponding parallel horizontal smooth machine lower face 38 of the respective pedestal leg. The weight of the truck alone will hold the surfaces 36 and 38 in contact with one another, and retainers 40 are provided in case the weight of the truck body 10 is removed for any reason. Such a mounting structure has the particular advantage that it only requires accurate machining of all butting horizontal and vertical surfaces on the pedestal legs and thereafter it is possible to adjust the vertical position of each journal in its pedestal by placing horizontal shims of the necessary thickness between the surfaces 36 and 38. Such a simple and economical method of provision for vertical adjustment is important both for first installation and subsequently if it becomes necessary to adjust the vertical height of the wheel set relatively to the truck frame, for example in order to compensate for factors that affect the truck and car height, such as the recontouring of the wheel treads and compression of the elastometric units as they age. In particular, the system gives relatively large freedom in selection of wheel diameter over a range of about 7.5 cm (3 ins), since all that is required is to increase the thickness of the installed shims as the diameter of the wheels is decreased.

This particular truck has a pivoting secondary suspension between the frame 10 and the bolster 24 comprising four elastomeric suspension members 42, also consisting of interleaved pieces of elastomeric material and metal plates, but of rectangular shape as seen in plan and elevation, the four members being disposed at the four corners of a rectangle, as seen in plan in FIG. 1. The members are also inclined inwardly upwardly toward one another and provide an effective virtual vertical centre axis about which the bolster pivots on the frame, the pivoting being accommodated by shear deformation of the elastomeric portions of the members. Longitudinal motion of the bolster is constrained by two horizontally disposed suspension members 44, of the same type as members 42, sandwiched between the bolster and supports 46 attached to the frame. A lateral tie rod 48 and two drag rods 49 are connected between the bolster and the car body, while a lateral damper 50 and two yaw dampers 52 are connected between the bolster and the frame.

The side frames are disposed sufficiently far apart that the wheels 20 are within the side frames; brake discs 54 of four respective disc brake units 56 are mounted on the axles 18 disposed between the wheels where they are shielded and are further from the trackside infra-red hot box sensors so as not to trigger these sensors and give a false alarm, which would result in unnecessary stopping of the train. The truck is also provided with four tread brake units 58, each of which engages the tread of a respective wheel, these units together exerting between one quarter and one third of the total braking effort, while the major portion is provided by the disc brake units. The provision of these tread brake units is found to be advantageous in maintaining the wheel treads in better condition than if only disc brake units are employed.

A particular problem that is encountered with passenger trucks, especially with the higher multi-level cars that are now employed to maximize passenger capacity, is control of lean (roll) and lateral motion of the car body on its trucks, especially on rail lines where the building gauge for the associated buildings, tunnels, etc. is somewhat close to that for the car bodies, so that the available clearances are correspondingly small. This factor also arises from the requirement for compactness in the vehicle, for example to allow for multi-level contruction, necessitating that the car floor is as low as possible, so that it becomes difficult to allow for the necessary clearances between the truck components as they move relative to one another.

Figure 6:
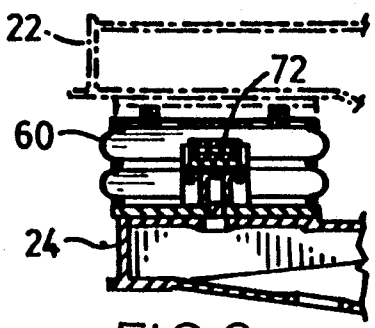
FIG. 6 is a cross-section through one end of the bolster showing an alternative air-spring tertiary suspension; and FIGS. *7a*, *7b* and *7c* are progressive plan views of a cam and cam follower combination employed to limit the lateral freedom of movement of the bolster relative to the truck frame as they are rotated from a straight-ahead steering relationship.
Figure 3:
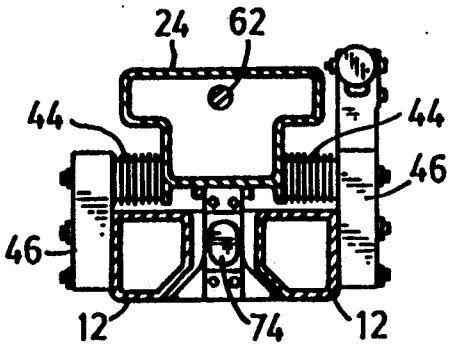
FIG. 3 is a cross-section through the truck bolster and the adjacent portion of the truck frame cross members taken on the line A—A in FIG. 1.
Figure 5:
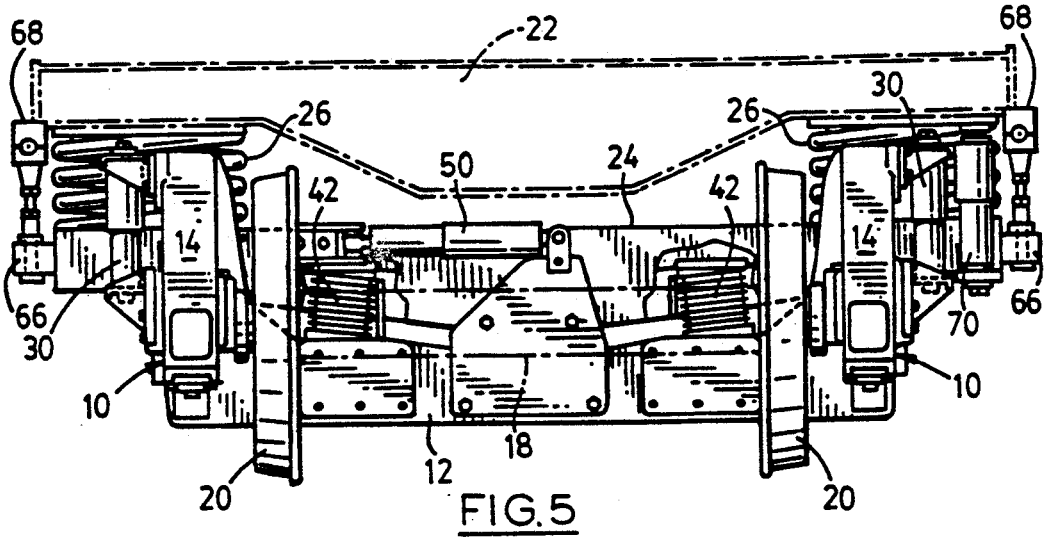
FIG. 5 is an end elevation of the outer end of the truck.
Figure 4:
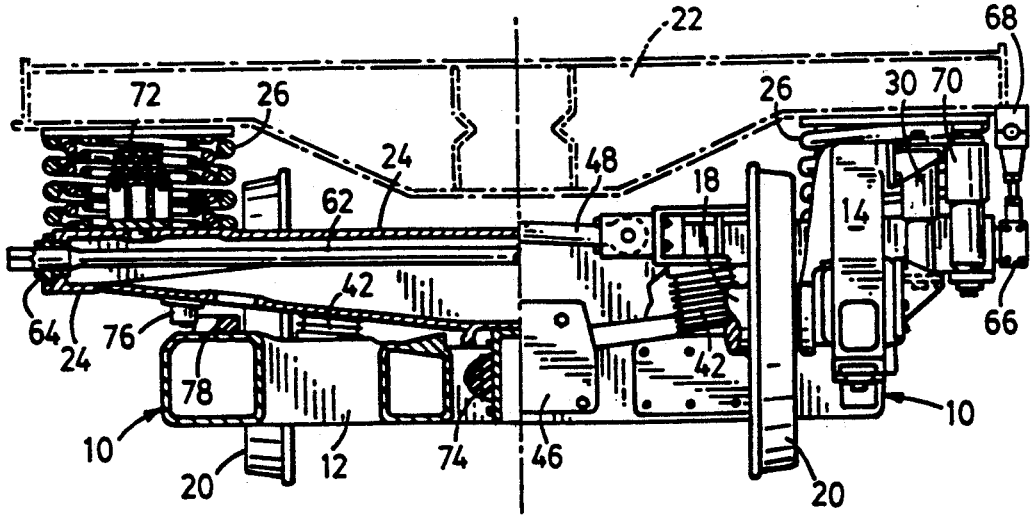
FIG. 4 is a part end elevation (right half) of the inner end of the truck and part transverse cross-section (left-half), the latter being taken on the line B—B in FIG. 1.
Figure 7A:
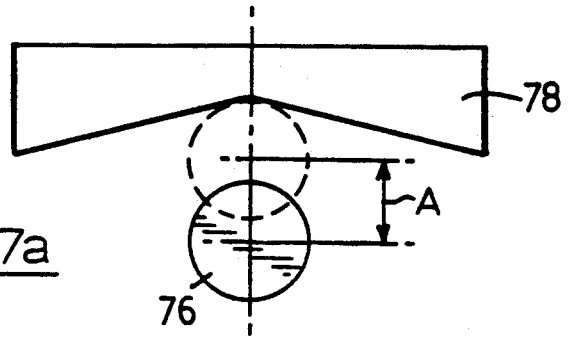
Figure 7B:
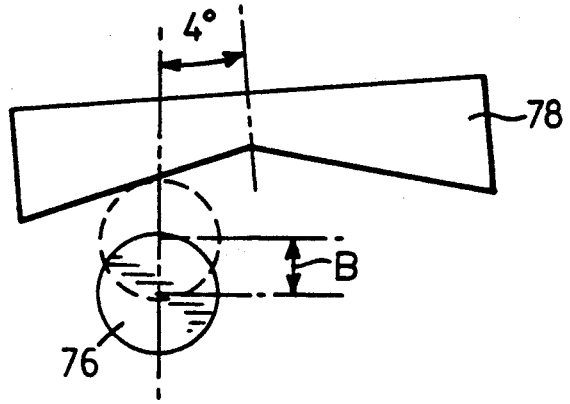
Figure 7C:
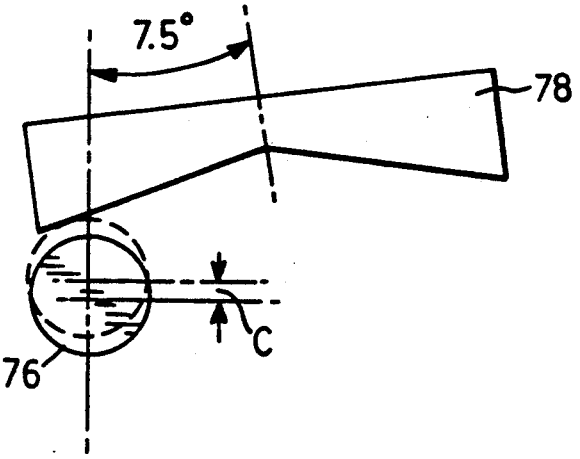

The bolster 24 is therefore made as long as possible so as to space the tertiary suspension means 26 as far apart as is permissible, this wide spacing enabling the suspension means to have a relatively low rate of vertical resistance, while also enabling them to resist roll motions of the body. In this embodiment each suspension means consists of a set of three concentric vertical springs disposed one inside the other. Such springs are employed because they are relatively inexpensive. Alternatively, as illustrated by FIG. 6, the suspension means may comprise flexible body air springs 60 which, although more expensive, have the advantage that by varying the internal pressure the car body can be maintained at a constant height despite variations in the body loading. A further advantage of the use of air springs in the tertiary suspension is that all three suspensions then have a complete interruption by resilient material of the acoustic path that they constitute between the parts that they connect, and there is no direct metal-to-metal contact between the truck parts, substantially reducing noise transmission from the rails and the wheel sets to the car body.

For many applications, especially when the car body has a relatively high centre of gravity, additional resistance to roll is required at the level of the tertiary suspension between the bolster and the car body, but this is difficult to provide in the suspension members 26 without making the suspension too stiff vertically. In accordance with this invention this additional roll resistance is provided by an anti-roll torsion bar 62 that it has proven possible to locate within the bolster, which is made hollow and is sufficiently deep to permit this, so that the bar is free to move as required without the possibility of contact or fouling with other parts of the truck. Thus, the bar is mounted inside the bolster by bearings 64 at each end of the bar, the two bearings being disposed at the respective bolster ends, each bar end carrying a horizontal lever arm 66 both of which extend in the same direction; each lever arm is connected at its other end via a respective vertical link 68 to the car body 22. Since the rod rotates freely in the bearings 64 it will follow freely any purely vertical motion of the car body relative to the bolster but will resist body roll attempting to twist the bar. Damping of the vertical movement of the car body is controlled by vertical dampers 70.

Again owing to the need with passenger cars to keep the car floor as low as possible, it becomes difficult to provide for the necessary clearances between the truck components as they move relative to one another and it is not always possible to find a special solution to this problem, as exemplified by the location of the anti-roll torsion bar 62 within the bolster interior. Positive stops must be provided for various motions, such as the vertical stops 72 in the suspension units 26 and the lateral stops 74 carried by the bolster. Lateral freedom is needed to absorb dynamic motion as the truck moves over lateral rail misalignments at speed, but with the amount of such freedom that is required for this purpose the wheels or truck frame tend toward contact with the car body when the truck is rotated to an extreme steering position (i.e. on a highly curved track) and at the same time the body is deflected laterally to its limit. Fortunately the most extreme track curves usually only occur in railway yards or repair shops where lateral freedom is not required and high speed movement is unlikely, and in general decreasing amounts of lateral freedom are required as truck rotation increases. We have found that it is possible to provide the necessary wide lateral freedom needed for normal running, while avoiding the possibility of undesired mechanical contacts under extreme steering and/or extreme lateral displacement conditions, by providing that the lateral movements of the bolster on the suspension units 42 are limited progressively as the steering from the "straight-ahead" neutral attitude increases, and this is done in this embodiment by providing downwardly-projecting pins 76 on the bolster at each end thereof which engage with specially chevron shaped cam faces of cam members 78 mounted on the frame with in this embodiment the concave chevron cam faces facing transversely outwards. As illustrated by FIGS. *7a* through *7c*, the shape of the cam faces is such that at zero rotation (FIG. *7a*), with the pin opposite to the depressed centre of the chevron, the maximum deflection (value A) is available and as the rotation increases (FIGS. *7b* and 7C) and the pin moves to be opposite to one or other of the progressively outwardly located cam faces, the deflection permitted decreases progressively correspondly to smaller and smaller values B and C. The provision of this variable spaced lateral stop greatly facilitates the satisfactory fitting of the car body to the truck by reducing the clearances that would otherwise be required to ensure that wheel and truck fouling of the body does not occur. The chevron shape illustrated for the cam face is a special case and the cam face is more generally to be characterised as of concave shape toward the pin, its specific shape depending upon the lateral deflection to be permitted for each value of steering rotation of the truck.

In this embodiment the cams 78 are mounted on the truck frame and the cooperating pins 76 are mounted on the bolster, but this arrangement can be reversed. Also the orientation of each cam face can be reversed with the chevron profile (or its equivalent) facing inward. The cam means are in this embodiment operative between the truck and the bolster since the secondary suspension between them permits both rotational and lateral motions. In an embodiment, for example, in which the pivotal and lateral motions are divided between the frame-to-bolster suspension and the bolster-to-car body suspension then the cam means will need to be operative between the truck frame and the car body in order to obtain the desired lateral restraint with pivoting steering motion.

We claim:

1. A railway truck comprising:

a truck frame having two parallel side frame members connected by a transversely extending transom and supporting two longitudinally spaced wheel and axle sets on which the truck runs;

primary suspension means interposed between the wheel and axle sets and the frame, connected thereto and mounting the wheel and axle sets on the frame;

a hollow bolster extending transversely centrally of the frame;

secondary suspension means interposed between the bolster and the frame, connected thereto and mounting the bolster on the frame for pivoting and lateral movement with respect thereto;

tertiary suspension means mounted on the bolster for attachment to the underside of a car body to mount the car body thereon for vertical movements;

a torsion bar extending transversely through the interior of the hollow bolster;

bearing means for the torsion bar mounted by the bolster and through which bearing means the torsion bar extends so as to be mounted for free rotation therein, the two ends of the torsion bar extending from the respective ends of the bolster and carrying respective links connecting the respective torsion bar ends to respective transversely spaced locations on the car body, whereby vertical movement of the car body is unopposed because of rotation of the torsion bar, and roll movement of the car body is opposed by torsion of the torsion bar.

2. A truck as claimed in claim 1, wherein the ends of the torsion bar are connected to the car body by respective horizontal links attached to the bar ends and extending in the same direction, and respective vertical links each connected between an end of the respective horizontal link and the car body.

3. A truck as claimed in claim 1, wherein the secondary suspension comprises four resilient suspension members of interleaved layers of metal and resilient material disposed on the truck frame in rectangular configuration, whereby rotation of the bolster is effected by horizontal shear of the suspension members.

4. A truck as claimed in claim 1, and comprising a cam having respective co-operating portions mounted on the bolster and on the frame and operative upon pivoting rotation of the bolster on the frame through the secondary suspension means from a straight-ahead steering attitude to reduce the permitted lateral movement through the secondary suspension means of the bolster on the frame.

5. A truck as claimed in claim 4, wherein the cam comprises at each end of the bolster a cam portion providing a concave cam face and mounted on the adjacent portion of the frame, and a cam follower pin portion mounted on the bolster and extending downward to be disposed relative to the cam face as to engage it with predetermined extents of rotational and lateral movement on the bolster.

6. A truck as claimed in claim 5, wherein the cam face is chevron shaped.

7. A truck as claimed in claim 1, wherein the truck frame has two transversely spaced parallel side frame members providing respective pairs of pedestal portions with each pair of pedestal portions supporting a respective pair of bearing journals in which is mounted a respective axle and wheel set on which the truck runs;

each pedestal portion having on respective parallel legs thereof two longitudinally spaced parallel opposed journal support surfaces against which a respective journal assembly can move vertically to adjust the height of the respective journal in the frame;

each journal assembly comprising two L-shaped intermediate members each having a vertical body part which is interposed between its journal and a respective leg of its pedestal and provides a vertical bearing surface butting and movable vertically against the respective vertical pedestal leg journal support surface; and each L-shaped intermediate member having a horizontal body part which is engaged with a corresponding lower horizontal surface of its pedestal leg to determine the vertical height of the journal, so that the height is adjustable by the interposition of thickness shims between the L-shaped member horizontal body part and the pedestal leg horizontal surface.

8. A truck as claimed in claim 7, wherein each journal assembly comprises between the journal and the two L-shaped intermediate members a pair of elastomeric suspension members of interleaved layers of metal and elastomeric material and of chevron shaped in plan, the vertical body of each L-shaped intermediate member being wedge-shape and tapered downward in side elevation to slope the respective suspension member downwards.

9. A railway truck comprising:

a truck frame having two parallel side frame members connected by a transversely extending transom and supporting two longitudinally spaced wheel and axle sets on which the truck runs;

primary suspension means interposed between the wheel and axle sets and the frame, connected thereto and mounting the wheel and axle sets on the frame;

a bolster extending transversely centrally of the frame;

secondary suspension means interposed between the bolster and the frame, connected thereto and mounting the bolster on the frame for pivoting and lateral movement with respect thereto;

tertiary suspension means mounted on the bolster for attachment to the underside of the car body to mount the car body for vertical movement thereon; and a cam having respective co-operating portions mounted on the bolster and the frame and operative upon pivoting rotation of the bolster relative to the truck frame through the secondary suspension means from a straight-ahead steering attitude to reduce the permitted lateral movement through the secondary suspension of the bolster on the truck frame.

10. A truck as claimed in claim 9, wherein the cam comprises at each end of the bolster a cam portion mounted on the adjacent portion of the frame and providing a concave cam face, and a cam follower pin portion mounted on the bolster and extending downward to be disposed relative to the cam face as to engage it with predetermined extents of rotational and lateral movement on the bolster.

11. A truck as claimed in claim 10, wherein the cam face is chevron shaped.

12. A railway truck comprising:

an integral truck frame having two transversely spaced parallel side frame members providing respective pairs of pedestal portions with each pair of pedestal portions supporting a respective pair of bearing journals in which is mounted a respective axle and wheel set on which the truck runs;

each pedestal having on respective parallel legs thereof two longitudinally spaced parallel opposed journal support surfaces against which a respective journal assembly can move vertically to adjust the height of the respective journal in the frame;

each journal assembly comprising two L-shaped intermediate members each having a vertical body part which is interposed between its journal and a respective leg of its pedestal and provides a vertical bearing surface butting and movable vertically against the respective vertical pedestal leg journal support surface; and each L-shaped intermediate member having a horizontal body part which is engaged with a corresponding lower horizontal surface of its pedestal leg to determine the vertical height of the journal, so that the height is adjustable by the interposition of thickness shims between the L-shaped member horizontal body part and the pedestal leg horizontal surface.

13. A truck as claimed in claim 12, wherein each journal assembly comprises between the journal and the two L-shaped intermediate members a pair of elastomeric suspension members of interleaved layers of metal and elastomeric material and of chevron shaped in plan, the vertical body of each L-shaped intermediate member being wedge-shaped and tapered downward in side elevation to slope the respective suspension member downwards.

* * * * *